United States Patent [19]

Chen

[11] 4,078,027

[45] Mar. 7, 1978

[54] WATER DISTRIBUTION SYSTEM FOR COOLING WATER

[75] Inventor: Tze-Ning Chen, Princeton, N.J.

[73] Assignee: Ingersoll-Rand Company, Woodcliff Lake, N.J.

[21] Appl. No.: 518,506

[22] Filed: Oct. 29, 1974

Related U.S. Application Data

[63] Continuation of Ser. No. 389,811, Aug. 20, 1973, abandoned, which is a continuation-in-part of Ser. No. 162,163, Jul. 13, 1971, abandoned.

[51] Int. Cl.[2] ..... B01F 3/04

[52] U.S. Cl. ..... 261/116; 261/DIG. 11; 261/DIG. 79; 239/558

[58] Field of Search ..... 261/115, 116, DIG. 11, 261/119 R, DIG. 79; 239/129, 178, 182, 558, 600

[56] References Cited

U.S. PATENT DOCUMENTS

| | | | |
|---|---|---|---|
| 1,233,119 | 7/1917 | Parker | 261/119 R |
| 1,462,363 | 7/1923 | Christensen | 261/DIG. 11 |
| 1,778,364 | 10/1930 | Lewis | 261/116 |
| 1,868,632 | 7/1932 | Edge | 261/115 |
| 2,591,100 | 4/1952 | Rouse | 261/119 R |
| 2,887,307 | 5/1959 | Koch | 261/116 |
| 3,360,906 | 1/1968 | Parkinson | 261/DIG. 11 |
| 3,785,625 | 1/1974 | Engalitcheff, Jr. | 261/116 |
| 3,807,145 | 4/1974 | Bradley et al. | 261/116 |

FOREIGN PATENT DOCUMENTS

| | | | |
|---|---|---|---|
| 198,209 | 11/1957 | Austria | 261/DIG. 11 |
| 406,192 | 11/1924 | Germany | 261/92 |
| 17,551 of | 1894 | United Kingdom | 261/115 |
| 11,393 of | 1908 | United Kingdom | 261/DIG. 11 |
| 437,282 | 10/1935 | United Kingdom | 261/DIG. 11 |

*Primary Examiner*—Tim R. Miles
*Attorney, Agent, or Firm*—Frank S. Troidl

[57] ABSTRACT

A water distribution system is disclosed which employs a plurality of spray nozzles arranged to induce air flow and maximize the cooling surface area of the falling water. The plurality of spray nozzles are arranged along a plurality of vertical planes and a plurality of horizontal planes.

The nozzles are located on at least two sides of a central area and are adapted to spray the water to be cooled toward the central area.

10 Claims, 9 Drawing Figures

WATER DISTRIBUTION SYSTEM FOR COOLING WATER

This is a continuation of application Ser. No. 389,811 filed Aug. 20, 1973, now abandoned, which in turn was a continuation-in-part of application Ser. No. 162,163 filed July 13, 1971, now abandoned.

This invention relates to water cooling systems; more particularly, this invention is a water distribution system wherein the arrangement and direction of spray nozzles induce air flow toward the central area of an array of nozzles.

As a result of growing concern about thermal pollution of rivers and lakes, large quantities of water are required to be cooled before reuse or discharge by industries. The methods presently being practiced include natural and forced draft wet cooling towers, natural and forced draft dry cooling towers, spray ponds, and cooling ponds. However, towers are extremely expensive and spray ponds and cooling ponds occupy large areas of land.

Wet natural draft cooling towers consist of two major parts, a cooling fill section and a stack. The fill breaks the water up into droplets or sheets to provide a large surface area for heat and mass transfer. The stack generates local movement of air so that it effectively passes through the fill section. Stack heights to 400 feet are not unusual, thus the expense of erecting a stack is a major element in the cost of natural draft cooling towers.

In the cooling pond or reservoir, there is no attempt to make more water surface area and more air movement other than that provided by nature. In this approach real estate cost and available space are limiting factors. Further, the lack of large reliable air movement capabilities limit their performance.

My invention provides large water surface area for heat and mass transfer and also generates a sufficient amount of air movement without the use of an expensive stack or a very large pond. Similar in purpose to the fill section in a cooling tower, my water distribution system breaks up the water into small droplets to provide a large surface area. The system can be in the form of a hollow polygon, a circular envelope, or two parallel in-line arrays or any other appropriate form. The height of the system varies depending on the desired cooling range, the approach and inlet wet bulb. The size of the polygon and dimensions of the central area are properly selected to induce air flow inward through the water distribution section and then upward at the middle.

The momentum exchange between water spray and air induces air flow by directing the sprays in the same direction as the desired air current. Since the air velocity in the fill section is normally in the order of 8 to 10 feet a second, the water droplets from the spray nozzle having a horizontal velocity component of 10 feet per second or higher will cause a positive induction of air flow and higher draft. With sufficient positive induction of air flow, a stack could be completely eliminated.

Briefly described, my new water distribution system for cooling water by air flow comprises a plurality of vertical water manifolds arranged along a plurality of vertical planes on each of at least two sides of a central area. A plurality of vertically spaced water manifolds are located on the vertical water manifolds along a plurality of horizontal planes. The water nozzles direct the water to be cooled toward the central area.

A particular advantage of my new water distribution system is that it is not necessary to include a tall stack or tower for the purpose of inducing draft with my system. Also, it is not necessary to include in the system auxiliary air moving mechanisms such as large fans. For example, the patent to Parkinson U.S. Pat. No. 3,360,906 granted Jan. 2, 1968 shows a water cooling tower which includes a single circle of water nozzles. Parkinson includes a high stack on his system. An example of the use of auxiliary apparatus to force the flow of air is shown by Koch U.S. Pat. No. 2,887,307. Koch uses a plurality of fans for increasing the flow of air through his water distribution system.

With my new water distribution system, no tower and no fans are required to induce draft. I have found through extensive tests and experiments that the sprays of water need not be used merely as a means for augmenting the air flow but can be used as the sole method of inducing the flow of air while at the same time cooling the water being ejected from the spray nozzles. My unexpected discovery eliminates the need for a cooling stack or eliminates the need for auxiliary equipment such as fans for inducing draft and their associate motors, transmissions and electrical controls.

The invention, as well as its advantages, may be further understood by reference to the following detailed description and drawings in which.

Like parts throughout the various views are referred to by like numbers.

Figure 1:
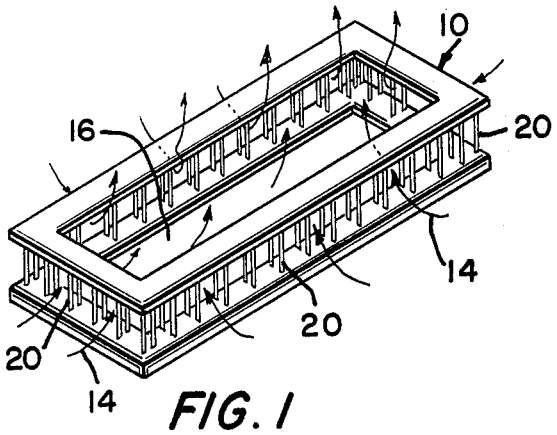
FIG. 1 is a schematic perspective view of a rectangular polygonal envelope with air flow lines.

Referring to the drawings and particularly to FIG. 1, the lattice work of spray nozzles is arranged in concentric polygons and envelops a central area devoid of spray nozzles. The envelope is designated generally by 10. The nozzle arrangement induces air flow 14 inwardly through the envelope to the open area 16. The air, heated and laden with moisture by the spray from the nozzles, then escapes upwardly from the central area into the atmosphere.

Figure 2:
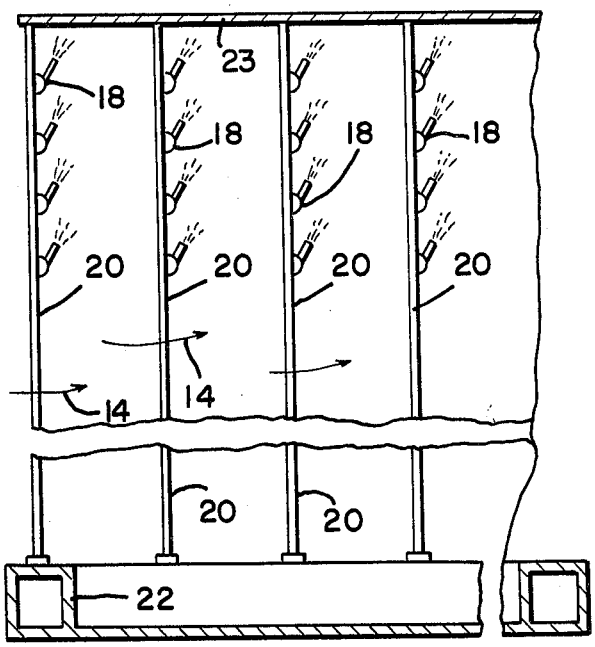
FIG. 2 is a cross section of a spray array.

FIG. 2 illustrates the tiered array of the nozzles 18 on manifolds 20 which rest on a footing 22. A cover 23 may be employed to exclude the warmer moist air which just rose from the central area.

Figure 3:
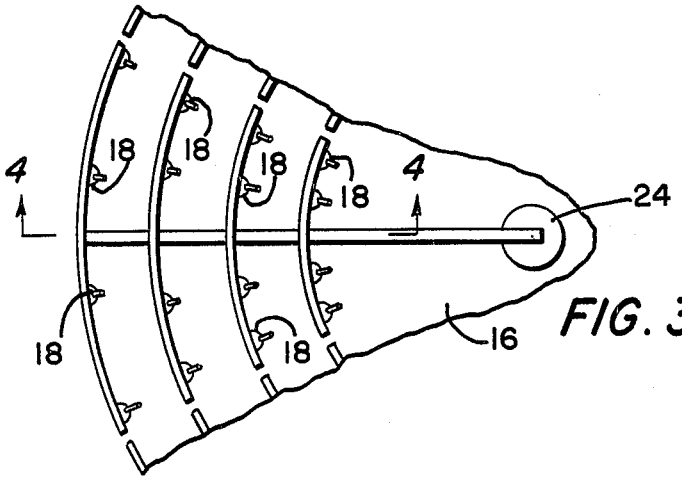
FIG. 3 is a plan view of a wedge shaped module for a circular envelope.
Figure 4:
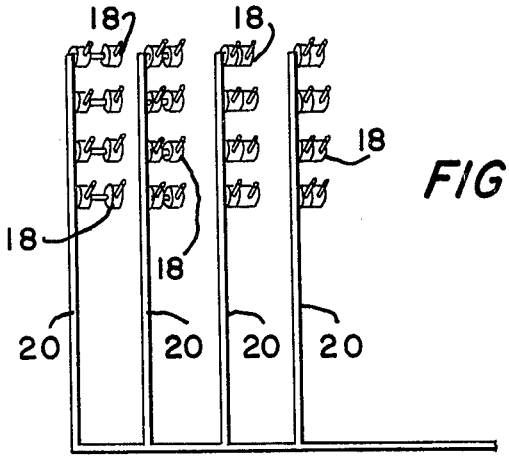
FIG. 4 is a view taken along lines 4—4 of FIG. 3 in the direction of the arrows.

Because of the immensity of some installations, it is convenient to assemble the nozzles in modular sections as shown in FIG. 3 which shows a wedge shaped module for a circular envelope. Each module has a valve connection 24 to matably join the manifolds to the main distribution pipe. While FIG. 3 shows a plan view of a wedge shaped module for a circular ring, it should be understood that other shapes would be appropriate such as rectangular or polygonal envelopes.

The nozzles 18 are arranged on manifolds 20 and spray hot water upwardly and inwardly toward the central area 16 of the array. The momentum exchange of the spray induces air flow through the array toward the central area. The air currents cool the falling droplets. When opposing currents meet in the central area, the warm moist air is deflected upward aided in its rise by the thermal draft that results from the heat taken from the water. Recirculation of the heated air by a vortex effect may be prevented by cover 23.

Figure 5:
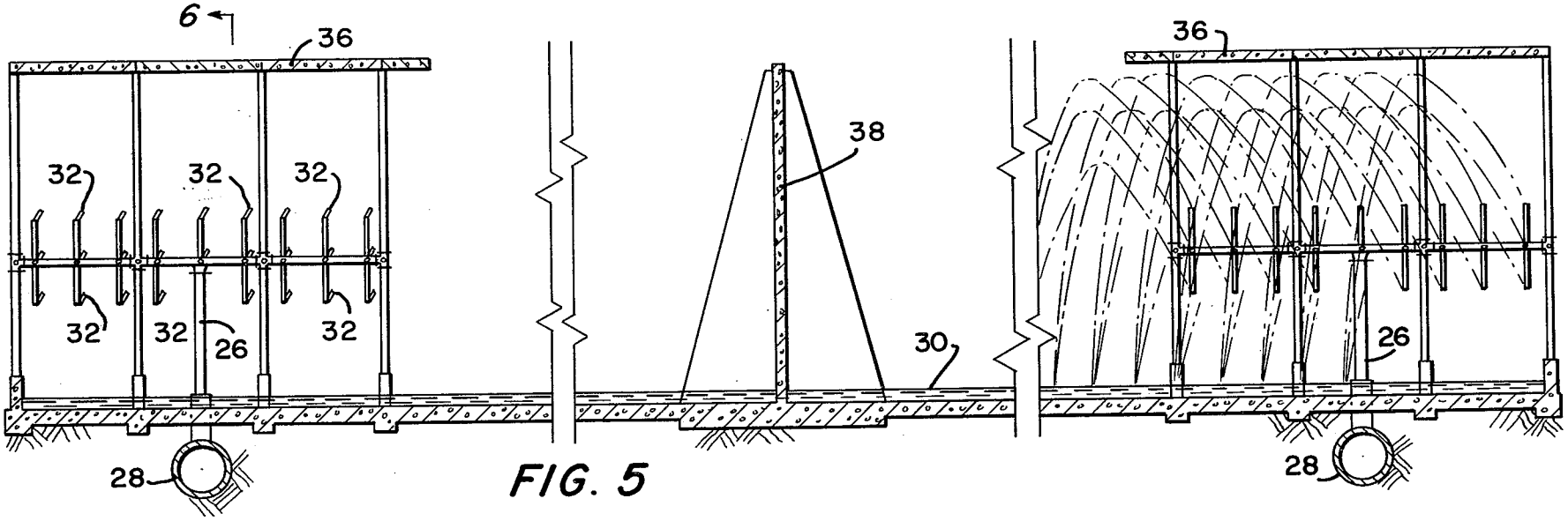
FIG. 5 is a transverse sectional view showing an in-line arrangement of nozzle arrays.
Figure 6:
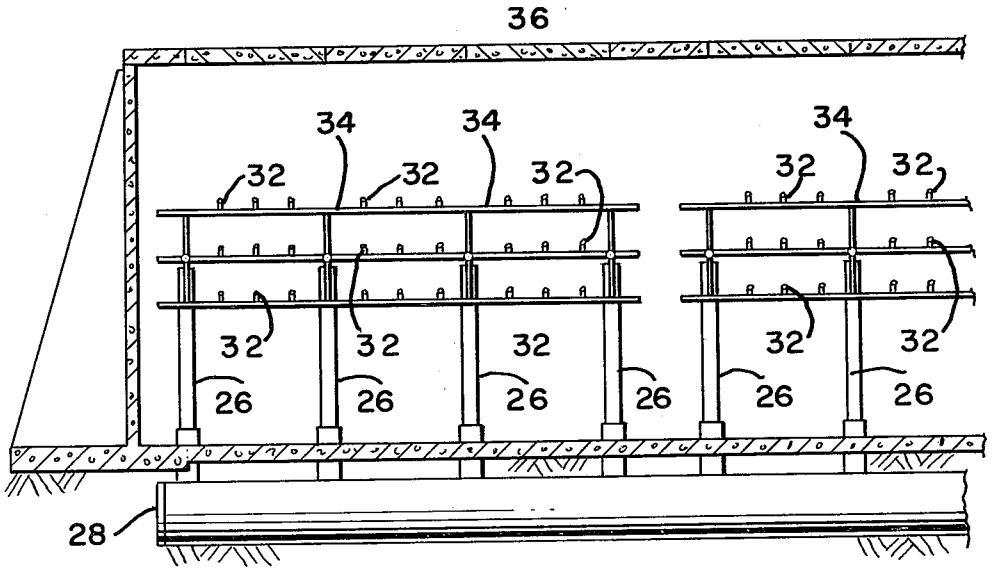
FIG. 6 is a partial view taken along lines 6—6 of FIG. 5 in the direction of the arrows.
Figure 7:
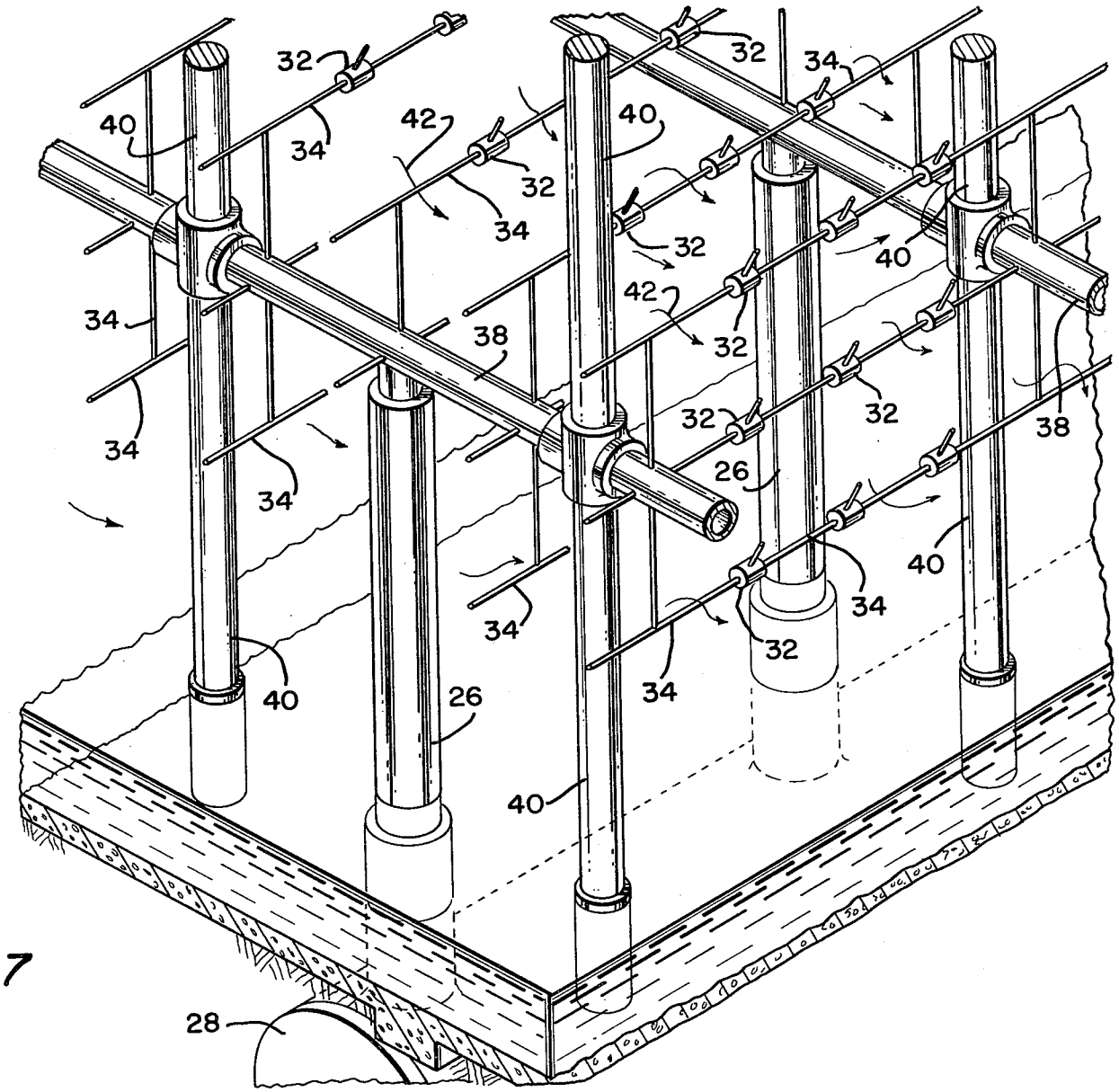
FIG. 7 is a perspective view on an enlarged scale illustrating a portion of the water distribution system of FIG. 5.

In the embodiment shown in FIGS. 5, 6, and 7, a plurality of vertical water manifolds 26 are connected to subsurface water supply pipes 28 on each side of a central area 30 devoid of spray nozzles (see FIG. 5 and FIG. 6). A plurality of vertically spaced water nozzles 32 are connected to the fluid pipes 34. The fluid pipes 34 are arranged along a plurality of vertical planes and also along a plurality of horizontal planes; therefore, the nozzles 32 are also arranged along a plurality of vertical planes and a plurality of horizontal planes. Though other arrangements of vertical and horizontal planes may be used, the distribution system shown in FIG. 5 through FIG. 7 disclose a water distribution system including fluid pipes 34, which are approximately equally spaced both vertically and horizontally. This provides a uniform distribution of water as it is ejected from the spray nozzles 32. The spray nozzles are directed at an angle from the horizontal and vertical planes to direct the spray of water toward the central area 30. The angular arrangement causes the water to be sprayed in an upward trajectory to aide in increasing the residence time of the spray droplets thereby maximizing the cooling effect.

In the embodiment shown in FIG. 5 and FIG. 6, and FIG. 7 there are two in-line arrangements of the water distribution system, equally spaced from the central area 30. Of course, if desired, the arrays can be arranged in concentric circles, concentric rectangles, or any other concentric polygon arrangement.

The upper most horizontal plane of nozzles is located sufficiently below the roof 36, if this embodiment is used to minimize the impingement of water droplets on the under side of the roof. Widespread impingement will impair the performance by diminishing the air flow and causing droplet agglomeration.

As shown in FIG. 7, the water to be cooled is fed through main water line 28 and upwardly through vertical manifolds 26. The vertical manifolds 26 are connected to water pipes 38 supported by vertical supports 40. The water pipes 38 supply the water to the perpendicularly arranged horizontal smaller water lines 34.

As can be seen in FIG. 5, a vertical baffle 38 may be provided in the central area 30 to direct the flow of air upwardly after the air has been drawn through the in-line arrangement of spray nozzles and cooled the warm water ejected from the spray nozzles.

As shown particularly in FIG. 7, the fluid pipes 34 are arranged along vertical planes which are substantially perpendicular to the direction of air flow, indicated by arrows 42.

Figure 9:
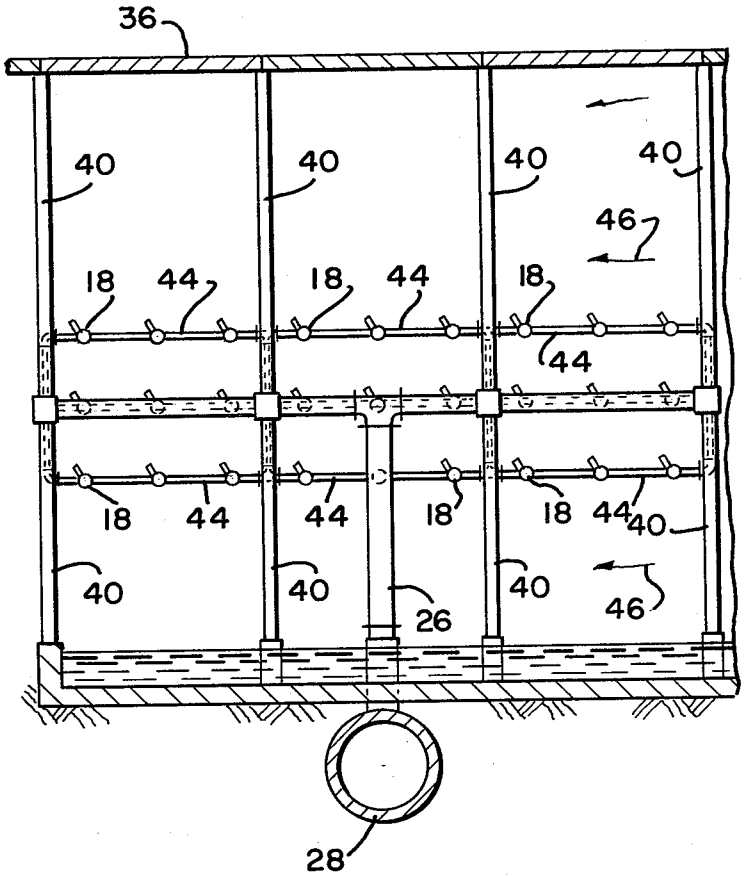
FIG. 9 is a sectional view taken along lines 9—9 of FIG. 8 in the direction of the arrows.
Figure 8:
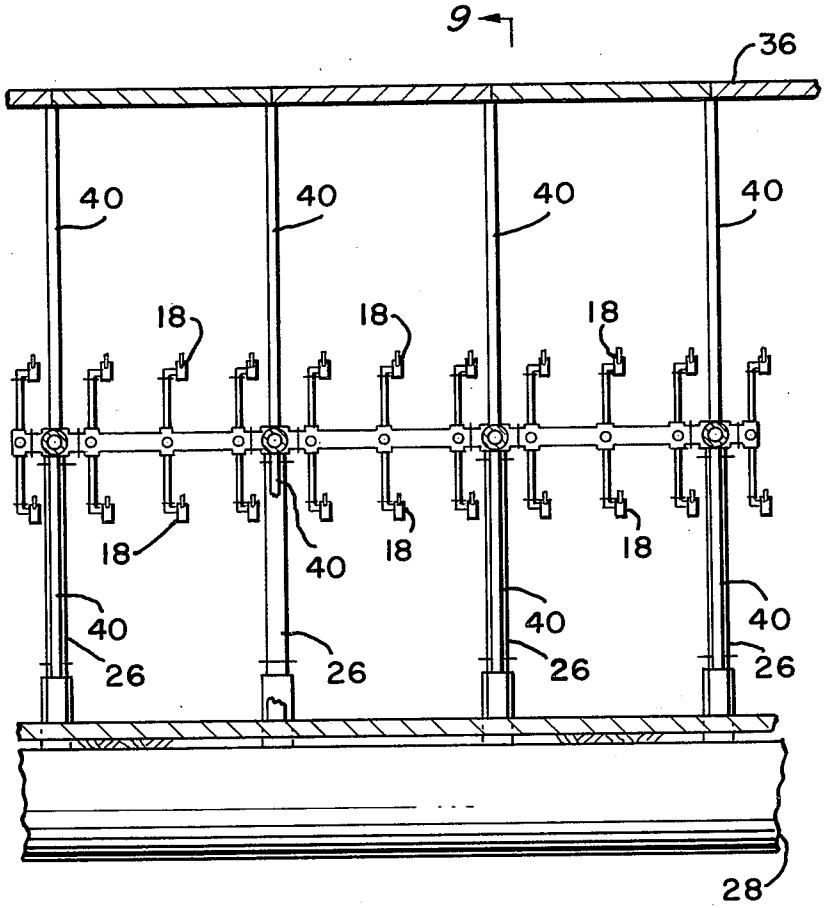
FIG. 8 shows a modified water distribution system.

In the embodiment of FIG. 8 and FIG. 9, the plurality of horizontal water lines 44 extend along vertical planes which are parallel to the direction of air flow 46 rather than perpendicular to the direction of air flow as shown in the modification of FIGS. 5 through 7. Spray nozzles 18 are mounted to direct water sprays at an angle upwardly and inwardly toward the central area; only one in-line array is shown in FIGS. 8 and 9, it being understood that another in-line array will be on the other side of the central area.

In operation, the warm water to be cooled is fed into the distribution system from the main water line and sprayed toward the central area. This warm water is cooled by the cooler air flowing through the water distribution system. The plurality of vertical planes and plurality of horizontal planes arrangement of nozzles permits efficient cooling of the water without requiring a stack or auxiliary mechanisms such as fans.

I claim:

1. A water distribution system used as the sole means of inducing the flow of air for cooling water by air flow comprising:

a spray nozzle arrangement on each of at least two sides of a central area, devoid of spray nozzles, each spray nozzle arrangement including spray nozzles mounted along a plurality of separated vertical planes having the central area as a common center and a plurality of separated horizontal planes, with a plurality of separated nozzles mounted along each vertical plane with some of the nozzles being spaced a different distance from the central area than other nozzles, and a plurality of separated nozzles mounted along each horizontal plane with some of the nozzles being spaced a different distance from the central area than other nozzles, the spacings of the spray nozzles being predetermined to provide a uniform distribution of water as it is ejected from the spray nozzles; all the spray nozzles in each of said two nozzle arrangements pointing upwardly at an acute angle with the horizontal to eject sprays at an acute angle with the horizontal and toward the central area, each of the nozzles being adapted to eject an unimpeded cone-shaped water spray, whereby the induced air currents are forced to pass entirely through each spray nozzle arrangement before discharging into the central area; and the air, heated and laden with moisture by the spray from the nozzles escapes vertically at the central area, thereby using the air to its fullest extent, in contacting and cooling the water droplets; and means for supporting and conducting water to the spray nozzles.

2. A water distribution system in accordance with claim 1 wherein:

there are two in-line spray nozzle arrangements substantially equally spaced from a central area.

3. A water distribution system in accordance with claim 1 wherein:

the spray nozzles are arranged in the shape of concentric circles.

4. A water distribution system in accordance with claim 1 wherein:

the spray nozzles are arranged in the shape of concentric rectangles.

5. A water distribution system in accordance with claim 1 wherein the plurality of horizontal planes are equally spaced.

6. A water distribution system in accordance with claim 1 wherein:

the system includes a roof and the uppermost horizontal plane of nozzles is located sufficiently below the roof to minimize the impingement of water droplets on the underside of the roof.

7. A water distribution system for cooling water in accordance with claim 1 wherein:

the means for supporting and conducting water to the spray nozzles comprises:

a plurality of horizontal water lines fluidly connected to vertical water manifolds and the spray nozzles are attached to the horizontal water lines.

8. The water distribution system of claim 7 wherein: the water nozzles attached to the plurality of horizontal water lines extend along vertical planes which are substantially perpendicular to the direction of air flow.

9. The water distribution system of claim 7 wherein: the plurality of horizontal water lines extend along vertical planes which are parallel to the direction of air flow.

10. The water distribution system of claim 7 wherein: the system includes a roof and the uppermost horizontal water line is a sufficient distance below the roof to minimize the impingement of water droplets on the underside of the roof.

* * * * *